US006824721B2

(12) United States Patent
Albe et al.

(10) Patent No.: US 6,824,721 B2
(45) Date of Patent: Nov. 30, 2004

(54) POLYPROPYLENE FIBERS

(75) Inventors: Lisa K. Albe, Isaac (BE); Scott D. Cooper, Humble, TX (US)

(73) Assignee: Fina Technology, Inc., Houston, TX (US)

( * ) Notice: Subject to any disclaimer, the term of this patent is extended or adjusted under 35 U.S.C. 154(b) by 266 days.

(21) Appl. No.: 10/112,798

(22) Filed: Mar. 29, 2002

(65) Prior Publication Data

US 2003/0183977 A1 Oct. 2, 2003

(51) Int. Cl.[7] ..... D01D 5/12; D01F 6/30
(52) U.S. Cl. ..... 264/210.8
(58) Field of Search ..... 264/210.8

(56) References Cited

U.S. PATENT DOCUMENTS

| | | | |
|---|---|---|---|
| 4,298,718 A | 11/1981 | Mayr et al. | |
| 4,544,717 A | 10/1985 | Mayr et al. | |
| 4,560,734 A | 12/1985 | Fujishita et al. | |
| 4,701,432 A | 10/1987 | Welborn, Jr. | |
| 4,794,096 A | 12/1988 | Ewen | |
| 4,808,561 A | 2/1989 | Welborn, Jr. | |
| 4,909,975 A | 3/1990 | Sawyer et al. | |
| 4,975,403 A | 12/1990 | Ewen | |
| 5,243,002 A | 9/1993 | Razavi | |
| 5,272,003 A | 12/1993 | Peacock | |
| 5,308,811 A | 5/1994 | Suga et al. | |
| 5,318,734 A | 6/1994 | Palmersten et al. | |
| 5,444,134 A | 8/1995 | Matsumoto | |
| 5,908,594 A | 6/1999 | Gownder et al. | |
| 6,476,172 B1 * | 11/2002 | Wachowicz et al. | 264/210.8 X |

FOREIGN PATENT DOCUMENTS

CN 2178104 A 12/1996

* cited by examiner

*Primary Examiner*—Leo B. Tentoni
(74) *Attorney, Agent, or Firm*—William D. Jackson

(57) ABSTRACT

Process for the production of fibers formed from an ethylene-propylene copolymer characterized as a random copolymer of ethylene and isotactic polypropylene having a random ethylene content within the range of 2–12 mole %. The propylene content of the copolymer can have an isotacticity of at least 90% meso diads. The copolymer is heated to a molten state and then extruded to form a fiber preform. The fiber preform is subject to a spinning speed of at least 500 meters per minute. This is followed by drawing the spun fiber preform at a draw ratio within the range of 1:1–6:1 to produce a continuous fiber of the ethylene-propylene copolymer. A specific ethylene-propylene copolymer has an ethylene content within the range of 6–8%.

12 Claims, 1 Drawing Sheet

POLYPROPYLENE FIBERS

FIELD OF THE INVENTION

This invention relates to fibers formed of ethylene-propylene copolymers and, more particularly, to such fibers and processes for their preparation.

BACKGROUND OF THE INVENTION

Isotactic polypropylene is one of a number of crystalline polymers that can be characterized in terms of the stereoregularity of the polymer chain. Various stereospecific structural relationships, characterized primarily in terms of syndiotacticity and isotacticity, may be involved in the formation of stereoregular polymers for various monomers. Stereospecific propagation may be applied in the polymerization of ethylenically-unsaturated monomers, such as $C_3$+alpha olefins, 1-dienes such as 1,3-butadiene, substituted vinyl compounds such as vinyl aromatics, e.g. styrene or vinyl chloride, vinyl chloride, vinyl ethers such as alkyl vinyl ethers, e.g, isobutyl vinyl ether, or even aryl vinyl ethers. Stereospecific polymer propagation is probably of most significance in the production of polypropylene of isotactic or syndiotactic structure.

Isotactic polypropylene is conventionally used in the production of fibers in which the polypropylene is heated and then extruded through one or more dies to produce a fiber preform which is processed by a spinning and drawing operation to produce the desired fiber product. The structure of isotactic polypropylene is characterized in terms of the methyl group attached to the tertiary carbon atoms of the successive propylene monomer units lying on the same side of the main chain of the polymer. That is, the methyl groups are characterized as being all above or below the polymer chain. Isotactic polypropylene can be illustrated by the following chemical formula:

(1)

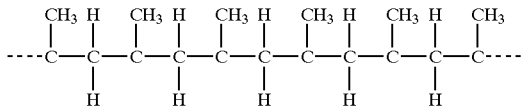

Stereoregular polymers, such as isotactic and syndiotactic polypropylene, can be characterized in terms of the Fisher projection formula. Using the Fisher projection formula, the stereochemical sequence of isotactic polypropylene, as shown by Formula (2), is described as follows:

(2)

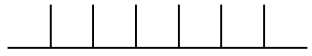

Another way of describing the structure is through the use of NMR. Bovey's NMR nomenclature for an isotactic pentad is . . . mmmm . . . with each "m" representing a "meso" dyad, or successive methyl groups on the same side of the plane of the polymer chain. As is known in the art, any deviation or inversion in the structure of the chain lowers the degree of isotacticity and crystallinity of the polymer.

Catalysts that produce isotactic polyolefins are disclosed in U.S. Pat. Nos. 4,794,096 and 4,975,403. These patents disclose chiral, stereorigid metallocene catalysts that polymerize olefins to form isotactic polymers and are especially useful in the polymerization of highly isotactic polypropylene. As disclosed, for example, in the aforementioned U.S. Pat. No. 4,794,096, stereorigidity in a metallocene ligand is imparted by means of a structural bridge extending between cyclopentadienyl groups. Specifically disclosed in this patent are stereoregular hafnium metallocenes which may be characterized by the following formula:

$$R''(C_5(R')_4)_2HfQp \quad (3)$$

In Formula (4), $(C_5\ (R')_4)$ is a cyclopentadienyl or substituted cyclopentadienyl group, R' is independently hydrogen or a hydrocarbyl radical having 1–20 carbon atoms, and R" is a structural bridge extending between the cyclopentadienyl rings. Q is a halogen or a hydrocarbon radical, such as an alkyl, aryl, alkenyl, alkylaryl, or arylalkyl, having 1–20 carbon atoms and p is 2.

Metallocene catalysts, such as those described above, can be used either as so-called "neutral metallocenes" in which case an alumoxane, such as methylalumoxane, is used as a co-catalyst, or they can be employed as so-called "cationic metallocenes" which incorporate a stable non-coordinating anion and normally do not require the use of an alumoxane. For example, syndiospecific cationic metallocenes are disclosed in U.S. Pat. No. 5,243,002 to Razavi. As disclosed there, the metallocene cation is characterized by the cationic metallocene ligand having sterically dissimilar ring structures that are joined to a positively charged coordinating transition metal atom. The metallocene cation is associated with a stable non-coordinating counter-anion. Similar relationships can be established for isospecific metallocenes.

Canadian Patent Application No. 2,178,104 to Peiffer discloses propylene polymers prepared in the presence of isospecific catalysts incorporating heavily substituted bis (indenyl) ligand structures and the use of such polymers in forming biaxially oriented polypropylene films. As described in the Canadian application, the polymers used have a very narrow molecular weight distribution, preferably less than three, and well-defined uniform melting points. In each case the ligand structures are substituted on both the cyclopentyl portion of the indenyl structure (at the 2 position), and also on the aromatic portion of the indenyl structure. The tri-substituted structures appear to be preferred, and less relatively bulky substituents are used in the case of 2-methyl, 4-phenyl substituted ligands or the 2-ethyl, 4-phenyl substituted ligands.

Catalysts employed in the polymerization of alpha-olefins may be characterized as supported catalysts or as unsupported catalysts, sometimes referred to as homogeneous catalysts. Metallocene catalysts are often employed as unsupported or homogeneous catalysts, although, as described below, they also may be employed in supported catalyst components. Traditional supported catalysts are the so-called "conventional" Ziegler-Natta catalysts, such as titanium tetrachloride supported on an active magnesium dichloride, as disclosed, for example, in U.S. Pat. Nos. 4,298,718 and 4,544,717, both to Myer et al. A supported catalyst component, as disclosed in the Myer '718 patent, includes titanium tetrachloride supported on an "active" anhydrous magnesium dihalide, such as magnesium dichloride or magnesium dibromide. The supported catalyst component in Myer '718 is employed in conjunction with a co-catalyst such and an alkylaluminum compound, for example, triethylaluminum (TEAL). The Myer '717 patent discloses a similar compound that may also incorporate an electron donor compound that may take the form of various amines, phosphenes, esters, aldehydes, and alcohols.

While metallocene catalysts are generally proposed for use as homogeneous catalysts, it is also known in the art to provide supported metallocene catalysts. As disclosed in U.S. Pat. Nos. 4,701,432 and 4,808,561, both to Welborn, a metallocene catalyst component may be employed in the form of a supported catalyst. As described in the Welborn '432 patent, the support may be any support such as talc, an inorganic oxide, or a resinous support material such as a polyolefin. Specific inorganic oxides include silica and alumina, used alone or in combination with other inorganic oxides such as magnesia, zirconia and the like. Non-metallocene transition metal compounds, such as titanium tetrachloride, are also incorporated into the supported catalyst component. The Welborn '561 patent discloses a heterogeneous catalyst that is formed by the reaction of a metallocene and an alumoxane in combination with the support material. A catalyst system embodying both a homogeneous metallocene component and a heterogeneous component, which may be a "conventional" supported Ziegler-Natta catalyst, e.g. a supported titanium tetrachloride, is disclosed in U.S. Pat. No. 5,242,876 to Shamshoum et al. Various other catalyst systems involving supported metallocene catalysts are disclosed in U.S. Pat. Nos. 5,308,811 to Suga et al and 5,444,134 to Matsumoto.

The polymers normally employed in the preparation of drawn polypropylene fibers are normally prepared through the use of conventional Ziegler-Natta catalysts of the type disclosed, for example, in the aforementioned patents to Myer et al. U.S. Pat. Nos. 4,560,734 to Fujishita and 5,318,734 to Kozulla disclose the formation of fibers by heating, extruding, melt spinning, and drawing from polypropylene produced by titanium tetrachloride-based isotactic polypropylene. Particularly, as disclosed in the patent to Kozulla, the preferred isotactic polypropylene for use in forming such fibers has a relatively broad molecular weight distribution (abbreviated MWD), as determined by the ratio of the weight average molecular weight ($M_w$) to the number average molecular ($M_n$) of about 5.5 or above. As disclosed in the Kozulla patent, the preferred molecular weight distribution, $M_w/M_n$, is at least 7.

A process for the production of polypropylene fibers formed from isotactic polypropylene prepared through the use of isospecific metallocene catalysts is disclosed in U.S. Pat. No. 5,908,594 to Gownder et al. As disclosed in Gownder, the polypropylene is characterized in terms of 0.5–2% of 2–1 insertions and has an isotacticity of at least 95% meso diads. This results in intermittent head-to-head insertions to provide a polymer structure that behaves somewhat in the nature of a random ethylene/propylene copolymer resulting in a variable melting point. The resulting fibers have good characteristics in terms of mechanical properties and machine operation, including machine speed.

In addition to fibers formed from stereoregular propylene homopolymers such as isotactic polypropylene, alpha olefin copolymers, or fibers made with synthetic resin fibers may also be formed from alpha-olefin copolymers. Thus, U.S. Pat. No. 4,909,975 to Sawyer et al discloses the production of fibers formed from ethylene-$C_3$–$C_{12}$ alpha olefin copolymers. In the Sawyer procedure the alpha olefin co-monomers copolymerized with the ethylene are $C_3$–$C_{12}$ alpha olefins and preferably $C_4$–$C_8$ alpha olefins with one octene being particularly preferred. The alpha olefin co-monomer or mixture of co-monomers, which is copolymerized with ethylene, is usually present in an amount of about 1–30 wt. %. Stated otherwise, the ethylene content of the ethylene-alpha olefin copolymer can range from about 70 to 99% in the copolymers employed in Sawyer.

SUMMARY OF THE INVENTION

In accordance with the present invention there is provided a process for the production of fibers formed from ethylene-propylene copolymers. In carrying out the invention there is provided a random copolymer of ethylene and isotactic polypropylene having a random ethylene content within the range of 2–12 mole %. The propylene content of the copolymer preferably has an isotacticity of at least 90% meso diads. The copolymer is heated to a molten state and then extruded to form a fiber preform. The fiber preform is subject to a spinning speed, preferably of at least 500 meters per minute. This is followed by drawing the spun fiber preform at a draw ratio within the range of 1:1–6:1 to produce a continuous fiber of the ethylene-propylene copolymer. Preferably the ethylene-propylene copolymer has an ethylene content within the range of 3–8% and more preferably within the range of 6–8%.

DETAILED DESCRIPTION OF THE INVENTION

Figure 1:
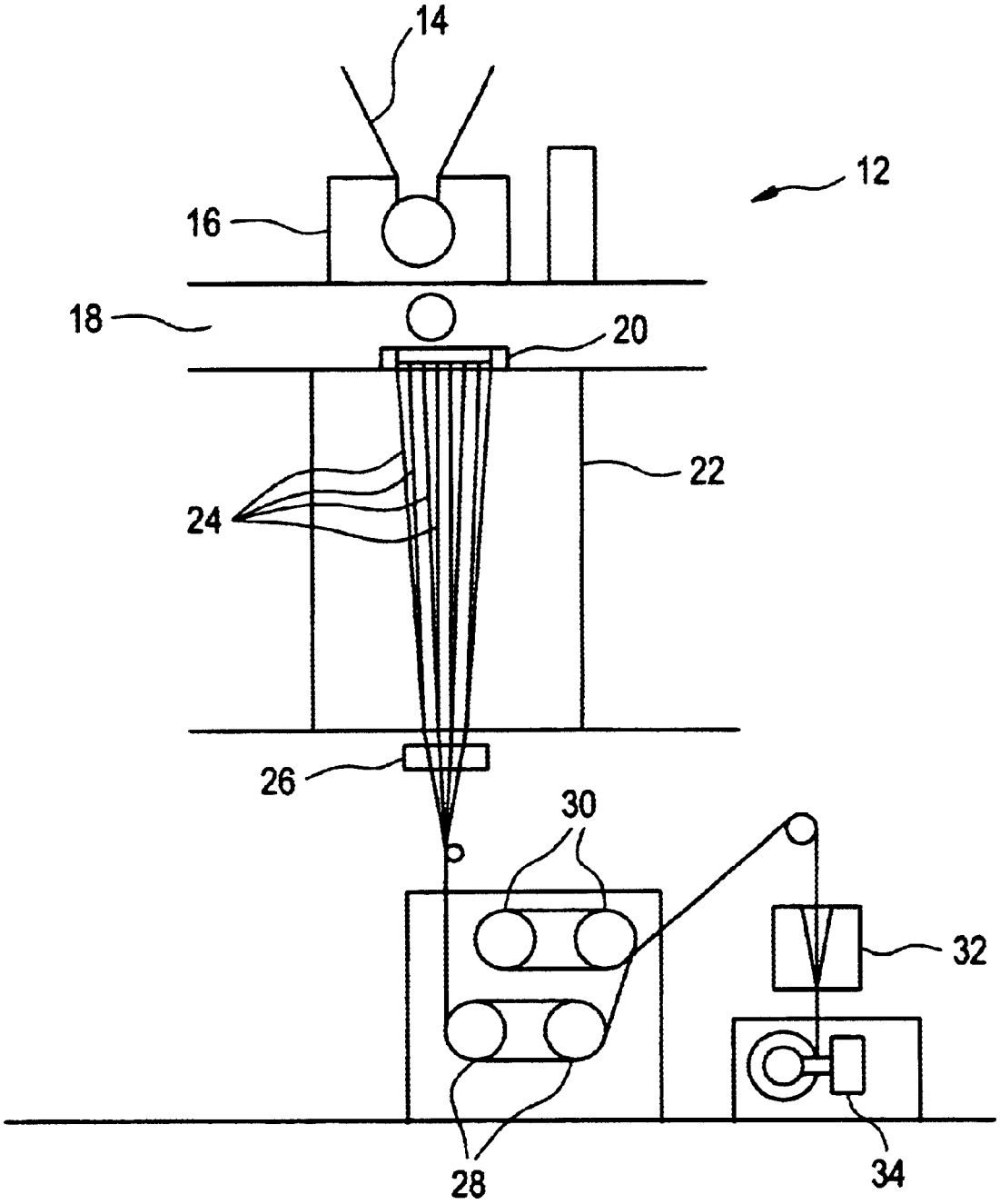
FIG. 1 is a schematic illustration of a Fourne fiber-spinning machine and drawing line of the type suitable for the use in carrying out the invention.

The fiber products of the present invention are formed using a particularly configured polyolefin polymer, as described in greater detail below, and by using any suitable melt spinning procedure, such as the Fourne fiber-spinning procedure. The use of ethylene-propylene copolymers of isotactic structure in accordance with the present invention provides for polymer structures which can be correlated with desired fiber characteristics, such as strength, toughness, and "hand" and in terms of the draw speed and draw ratios employed during the fiber-forming procedure.

As a result, the improved "hand" can be characterized in terms of softer fabrics due to improved thermal bonding characteristics associated with the ethylene content of the ethylene-propylene copolymer. The ethylene-propylene copolymers employed in the present invention can be bonded at lower temperatures than the corresponding homopolymers, thus resulting in softer fabrics.

The fibers produced in accordance with the present invention can be formed by any suitable melt spinning procedure, such as the Fourne melt spinning procedure, as will be understood by those skilled in the art. In using a Fourne fiber-spinning machine the ethylene-propylene copolymers, typically in the form of pellets, is passed from a suitable supply source and heated to a suitable temperature for extrusion within the range of about 140°–180° C. and then through a metering pump to a spin extruder. The fiber preforms thus formed are cooled in air then applied through one or more Godets to a spinning role which is operated at a desired spinning rate, typically about 500–1500 meters per minute. The thus-formed filaments are drawn off the spin role to the drawing roller that is operated at a substantially enhanced speed in order to produce the drawn fiber. The draw speed normally will range from about 500–4000 meters per minute and is operated relative to the spinning Godet to provide the desired draw ratio normally within the range of 1:1 to 6:1.

A suitable Fourne fiber-spinning machine, which may be used in carrying out the invention, is illustrated in FIG. 1. The random copolymer is passed from a hopper 14 through a heat exchanger 16 where the copolymer pellets are heated to the extrusion temperature and then through a metering pump 18 (also called a spin pump) to a spin extruder 20 (also called a spin pack). The portion of the machine from hopper 14 through the spin pack 20 is collectively referred to an extruder 12. The fiber preforms 24 thus formed are cooled in air in quench column 22 and then passed through a spin finisher 26. The collected fibers are then applied through one or more Godets to a take-away roll, illustrated in this embodiment as rolls 28 (also collectively referred to as Godet 1). These rolls are operated at a desired take-away rate (referred to as the G1 speed), about 500–1500 meters per minute, in the present invention. The thus-formed filaments are drawn off the spin role to the drawing rollers 30 (also collectively referred to as Godet 2) that are operated at a substantially enhanced speed (the draw speed or G2 speed) in order to produce the drawn fiber. The draw speed normally will range from about 500–4,000 meters per minute and is operated relative to the take-away Godet to provide the desired draw ratio normally within the range of 1:1 to 6:1. In one embodiment the spun and drawn fiber is passed through a texturizer 32 and then wound up on a winder 34. While the illustrated embodiment and description encompasses the spinning and drawing of a fully oriented yarn, the same equipment may also be used to make a partially oriented yarn. In this case the drawing step is omitted, leaving only the act of spinning the yarn out of the extruder. This step is often accomplished by connecting winder 34 immediately following spin finisher 26 and involves bypassing drawing rollers 30. The force of winding/spinning the yarn off of the extruder does result in some stress and elongation, partially orienting the yarn, but does not provide the full benefits of a complete drawing process. For a further description of suitable fiber-spinning procedures for use in the present invention, reference is made to the aforementioned U.S. Pat. No. 5,272,003 and U.S. Pat. No. 5,318,734, the entire disclosures of which are incorporated herein by reference.

As noted previously, a preferred practice in forming polypropylene fibers has been to produce the fibers from stereoregular isotactic polypropylene produced by supported Ziegler-Natta catalysts, that is, catalysts such as zirconium or titanium tetrachloride supported on crystalline supports such as magnesium dichloride. An alternative procedure has been to use polypropylene produced by isospecific metallocenes.

The present invention can be carried out with ethylene-propylene copolymers prepared in the presence of isospecific metallocenes such as those disclosed in the aforementioned U.S. Pat. Nos. 5,272,003 and 5,318,734 and in the Canadian Peiffer Patent Application No. 2,178,104. Alternatively, the present invention may be carried out by employing ethylene-propylene copolymers produced by an isospecific metallocene based upon an indenyl structure which is mono-substituted at the proximal position and otherwise unsubstituted, with the exception that the indenyl group can be hydrogenated at the 4, 5, 6, and 7 positions. Preferably, however, the invention is carried out with ethylene-propylene copolymers prepared by catalysis of a mixture of ethylene and propylene over a supported Ziegler-Natta catalyst of the type disclosed in the aforementioned patents to Myer et al.

The invention involves the use of a propylene ethylene random copolymer incorporating a significant amount of ethylene, but still no more than about 12% ethylene in the random copolymer. Thus, the present invention proceeds contrary to the conventional prior art teachings, such as found in the aforementioned patent to Sawyer, in using substantially less amounts of the ethylene relative to the alpha-olefin comonomer and in using propylene in contrast to the relatively higher molecular weight alpha olefins, specifically, octene, as preferred in the Sawyer procedure. However, as described below, notwithstanding these distinctions, the present invention can be employed to produce relatively fine denier fibers as well as coarser denier fibers.

In a preferred embodiment of the present invention, the ethylene-propylene copolymer contains ethylene in an amount within the range of 2–12 mole %. In most cases the ethylene content will be within the range of about 2–10% and preferably 3–8 mole %. The preferred lower limit of the ethylene is about 4 mole %. In many cases a somewhat higher ethylene content will be desired to impart the desired characteristics of a softer "hand" as described below, and in this case the ethylene content will be within the range of about 6–8 mole %.

As noted previously, while metallocene-type catalysts can be employed in producing the ethylene-propylene copolymers of the present invention, the preferred catalyst is a supported Ziegler-Natta of the type disclosed in the aforementioned patents to Myer. A preferred supported Ziegler-Natta catalyst is a Group V or Group VI halide supported on a magnesium halide or alkoxy magnesium support. Specific transition metal halides are titanium, zirconium, hafnium, or vanadium tetrahalide supported on magnesium dichloride or diethoxy magnesium or mixtures thereof, i.e., magnesium ethoxy chlorides. The supported Ziegler-Natta catalyst may be employed with internal electron donors, with this being particularly preferred. An especially suitable supported Ziegler-Natta catalyst is titanium tetrachloride supported on diethoxy magnesium, ethoxy magnesium chloride, or magnesium dichloride employing dibutylphthylate as an internal electron donor. The supported Ziegler-Natta catalyst is employed in combination with a co-catalyst such as a trialkylaluminum, specifically with triethyl or trimethyl aluminum particularly being preferred. It usually will be desirable in carrying out the invention to employ an external electron donor in the course of copolymerizing the ethylene and propylene to arrive at the ethylene-propylene random copolymer. Typical electron donors used include organic silicon compounds such as organosilanes, specifically diphenyldimethoxysilane. The external electron donor acts to facilitate highly stereoregular polymers notwithstanding significant quantities of ethylene monomer in the random copolymer. A catalyst of this nature was used in the experimental work described below.

In production of the ethylene-propylene random copolymer used in the present invention, both propylene and ethylene are fed to a polymerization reactor, typically a continuous-type reactor, together with the supported catalyst. When employing a Ziegler-Natta isospecific catalyst, the catalyst normally will be somewhat more active for ethylene polymerization than for propylene polymerization. Thus, if the desired ethylene-propylene random copolymer has an ethylene content of 8%, the comonomer mixture supplied to the reactor would contain about 7% ethylene and 93% propylene, resulting in a random copolymer of 8% ethylene and 92% propylene.

As will be recognized from the foregoing description, the ethylene-propylene random copolymer employed in the present invention can be characterized by the following formula:

$$(CH_2CH_2)_n(CH_2CH_3—CH)_m \quad (4)$$

In Formula 4, m will be a value within the range of about 0.88 to 0.98 and n will be a value within the range of 0.2–0.12.

The isotactic propylene polymer structure of the copolymer used in the present invention will be predominantly characterized in terms of the 1–2 insertions typically found in isotactic polypropylene. The isotactic propylene segment will typically contain an occasional mistake resulting in r rather than the normal nm diads, but it is preferred in carrying out the present invention that the polypropylene segments have an isotacticity as measured in terms of meso-diads of at least 90% meso diads. The ethylene monomers are, as noted above, inserted randomly into the polymer chain.

Having described specific embodiments of the present invention, it will be understood that modifications thereof may be suggested to those skilled in the art, and it is intended to cover all such modifications as fall within the scope of the appended claims.

What is claimed is:

1. In a method for the production of fibers formed from ethylene propylene co-polymers, the steps comprising:

(a) providing a random co-polymer of ethylene and isotactic polypropylene having an ethylene content within the range of 2–12 mole % with irregularities in the isotactic polymer structure predominantly characterized in terms of 1,2 insertions;

(b) heating said co-polymer to a molten state and extruding said molten co-polymer to form a fiber preform; and (c) spinning said fiber preform and subsequently drawing said fiber preform at a draw ratio within the range of 1–6 to produce a continuous ethylene propylene co-polymer fiber.

2. The method of claim 1 wherein said ethylene-propylene random co-polymer has an ethylene content within the range of 4–10 mole%.

3. The method of claim 2 wherein said co-polymer is produced by the polymerization of propylene and ethylene in the presence of a supported heterogeneous Ziegler-Natta catalyst.

4. The method of claim 1 wherein said ethylene-propylene copolymer has an ethylene content within the range of 6–8 mole %.

5. The method of claim 1 wherein said co-polymer is produced by the polymerization of propylene and ethylene in the presence of a supported heterogeneous isospecific Ziegler-Natta catalyst.

6. The method of claim 5 wherein said supported Ziegler-Natta catalyst is titanium tetrachloride supported on supports selected from the group consisting of diethoxymagnesium, magnesium ethoxychloride, magnesium dichloride and mixtures thereof.

7. The method of claim 1 wherein the ethylene-propylene co-polymer is produced by the copolymerization of ethylene and propylene in the presence of an isospecific metallocene catalyst.

8. The method of claim 1 wherein the propylene content of said ethylene propylene copolymer is characterized by an isotacticity of at least 90% meso diads.

9. The method of claim 1 wherein said copolymer is heated to a temperature within the range of 140–180° C. and then extruded to form said fiber preform.

10. The method of claim 1 wherein said fiber has a tenacity of at least 2 grams per denier.

11. The method of claim 1 wherein said fiber preform is drawn at a draw ratio effective to produce a fiber within the range of 0.5–15 denier per fiber.

12. The method of claim 11 wherein said fiber is drawn to a fineness within the range of 1–8 denier per fiber.

* * * * *